US007491279B1

(12) United States Patent
Baker

(10) Patent No.: US 7,491,279 B1
(45) Date of Patent: Feb. 17, 2009

(54) EMULSION EXPLOSIVE

(75) Inventor: James J. Baker, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 117 days.

(21) Appl. No.: 11/009,846

(22) Filed: Dec. 9, 2004

(51) Int. Cl.

| | |
|---|---|
| ***C06B 47/00*** | (2006.01) |
| ***C06B 25/20*** | (2006.01) |
| ***D03D 23/00*** | (2006.01) |
| ***D03D 43/00*** | (2006.01) |

(52) U.S. Cl. ..... 149/100; 149/1; 149/109.2; 149/109.4

(58) Field of Classification Search ..... 149/1, 149/100, 109.2, 109.4

See application file for complete search history.

(56) References Cited

U.S. PATENT DOCUMENTS

| | | | | |
|---|---|---|---|---|
| 3,230,700 | A * | 1/1966 | Larsen | 60/215 |
| 5,397,399 | A * | 3/1995 | Lownds | 149/109.6 |
| 6,165,295 | A * | 12/2000 | Wagaman | 149/46 |
| 6,808,573 | B2 | 10/2004 | Hales | 149/109.6 |

* cited by examiner

*Primary Examiner*—Jerry Lorengo
*Assistant Examiner*—James E McDonough
(74) *Attorney, Agent, or Firm*—Fredric Zimmerman

(57) ABSTRACT

An emulsion explosive including a discontinuous phase dispersed in a liquid fuel continuous phase and is provided. The discontinuous phase contains a liquid oxidizer other than an inorganic oxidizer salt. Also provided are articles of manufacture containing the emulsion explosive.

16 Claims, 1 Drawing Sheet

EMULSION EXPLOSIVE

STATEMENT REGARDING FEDERALLY SPONSORED RESEARCH OR DEVELOPMENT

The invention described herein may be manufactured and used by or for the Government of the United States of America for governmental purposes without the payment of any royalties thereon or therefore.

BACKGROUND OF THE INVENTION

1. Field of the Invention

This invention pertains to the field of energetic emulsions, and further pertains to related articles of manufacture and methods.

2. Description of the Related Art

Conventional emulsion explosives are water-in-oil emulsions, in which a discontinuous phase of inorganic oxidizer salt solution droplets is dispersed in a continuous organic fuel phase. The droplets, which constitute a dispersion or emulsion phase, are held in place by a water-in-oil emulsifier provided the emulsified state remains stable. An emulsifier (or surfactant) is usually included in the emulsion for promoting formation and stability of the discontinuous phase.

The excellent detonation velocity characteristic of emulsion explosives makes this class of explosives particularly important and contributes to its wide used. For example, detonation velocities of cap-sensitive emulsion explosives have been approximated to be in the range of 18,000 to 25,000 feet per second (5490 m/s to 7620 m/s). The reason for the high detonation velocity of emulsion explosives is the intimacy of mixing of the emulsion explosive. The continuous phase of fuel surrounds each discontinuous phase droplet of inorganic oxidizer, providing an extremely large interfacial surface area between the two phases.

Three major drawbacks reduce the effectiveness and utilization of emulsion explosives. The first drawback is that conventional emulsion explosives have relatively low densities, which limits the detonation pressure of the explosive. The low density is attributable to the addition of glass microballoons, which are added to the emulsion to increase sensitivity. The second drawback is the use of water to dissolve the inorganic salt oxidizer. Water is inert, and therefore does not add energy to the reaction. In fact, heat generated by the reaction of the energetic components is partially consumed due to vaporization of water. The third drawback is that inorganic salt oxidizers such as ammonium nitrate are in a meta-stable state when the emulsion is formed (usually at elevated temperature). Ambient temperature is below the saturation point of many commercially available emulsion explosives, thus requiring that the explosives be kept in a warm atmosphere to avoid crystallization of the oxidizer. Surface tension of the droplets is relied upon to keep the ammonium nitrate in solution. If the temperature becomes too low, the driving force of crystallization exceeds that of surface tension. Thus, crystallization is particularly likely in cold environments and during temperature cycling, such as daily ambient temperature variations and seasonal ambient temperature changes. The crystallized ammonium nitrate has a needle-like shape that may puncture nearby droplets, causing the droplets to collapse and the ammonium nitrate crystals to agglomerate. Eventually, the emulsion is destabilized and the usefulness of the emulsion explosive is reduced or lost, e.g., the emulsion explosive can be rendered undetonable.

SUMMARY OF THE INVENTION

It is an object of the present invention to provide an emulsion explosive that may be effectively operated without (or with a reduced amount of) microballoons or other equivalent sensitizing components.

It is another object of the present invention to provide an emulsion explosive that is resistant to oxidizer crystallization in temperature-cycling and cold environments.

In accordance with the purposes of the invention as embodied and broadly described herein, a first aspect of this invention provides an emulsion explosive comprising a liquid fuel continuous phase, and a discontinuous phase dispersed in the continuous phase. The discontinuous phase comprises a plurality of droplets containing an oxidizer other than an inorganic oxidizer salt, the oxidizer present in a liquid state.

In accordance with the purposes of the invention as embodied and broadly described herein, a second aspect of the invention provides an article of manufacture comprising the emulsion explosive of the first aspect of the invention. Examples of articles include missile/rocket-propelled warheads, non-propulsive warheads, and torpedoes.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

Figure 1:
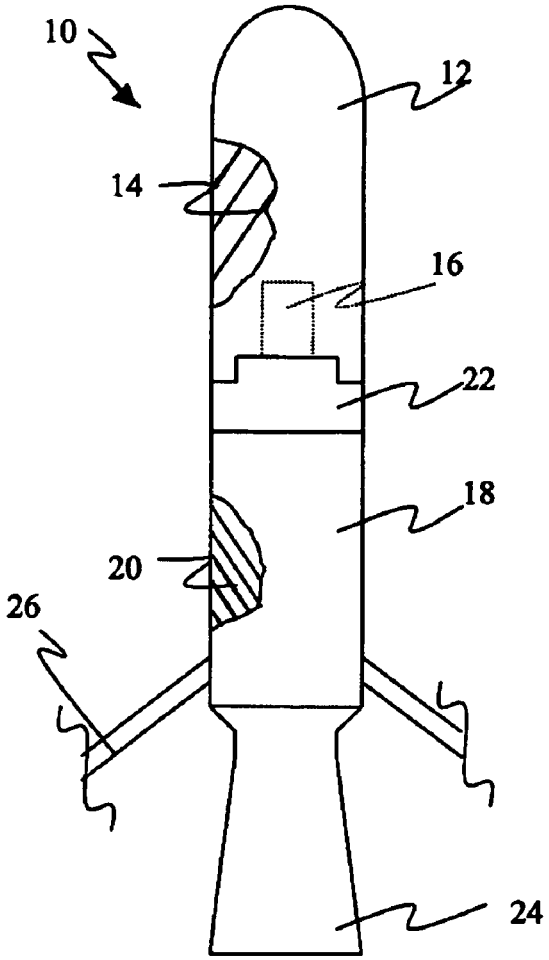
FIG. 1 is a schematic, partially cut-away side view of a rocket-propelled warhead according to an embodiment of the invention.

DETAILED DESCRIPTION OF CERTAIN PREFERRED EMBODIMENTS AND METHODS OF THE INVENTION

Reference will now be made in detail to the presently preferred embodiments and methods of the invention as illustrated in the accompanying drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

A preferred embodiment of the invention provides an emulsion explosive comprising a continuous phase comprising a liquid fuel, and a discontinuous phase dispersed in the continuous phase. The discontinuous phase comprises a plurality of droplets containing an oxidizer different from an inorganic oxidizer salt.

The liquid fuel of the continuous phase preferably comprises an organic liquid that is aliphatic, alicyclic, and/or aromatic. The organic liquid may be saturated or unsaturated, so long as the liquid fuel is immiscible with the discontinuous phase. Examples of fuels that may be selected include mineral oil, silicone oil, waxes, paraffin oils, esters (e.g., dioctyl adipate, isodecyl pelargonate, etc.), mixtures of liquid hydrocarbons generally referred to as petroleum distillates such as gasoline, kerosene and diesel fuels, and vegetable oils such as corn oil, cottonseed oil, peanut oil, and soybean oil, and mixtures of the above. Aliphatic and aromatic nitro-compounds and chlorinated hydrocarbons also can be used, either alone or in combination with other liquid fuels. It is preferred, however, that the liquid fuel comprise, and optionally consist essentially of or consist of, a non-corrosive oil that remains stable in the presence of the liquid oxidizers of the inventive emulsion explosive. Particularly preferred liquid fuels are mineral oil and silicone oil.

Optionally, in addition to the immiscible liquid organic fuel, the emulsion explosive further comprises solid or other liquid fuels or both. Examples of solid fuels that can be used are finely divided aluminum particles; finely divided carbonaceous materials such as gilsonite or coal; finely divided vegetable grain such as wheat; and sulfur. Miscible liquid fuels, also functioning as liquid extenders, may also be used. These additional solid and/or liquid fuels can be added generally in amounts ranging up to about 25% by weight.

The liquid oxidizer forming the discontinuous phase comprises a liquid oxidizer other than an inorganic oxidizer salt (e.g., ammonium, potassium, and sodium salts of perchlorates and nitrates). More preferably, the liquid oxidizer is substantially or entirely free of inorganic oxidizer salt, and still more preferably is free of dissolved solid oxidizers. In a preferred embodiment, the oxidizer is liquid at 5° C., and more preferably remains in a liquid state throughout a range of 5° C. to 20° C. (at atmospheric pressure), i.e., has a freezing point lower than 5° C. and a boiling point higher than 20° C. In other preferred embodiments, the oxidizer remains in a liquid state throughout a range of 5° C. to 32° C. (at atmospheric pressure), i.e., has a freezing point lower than 5° C. and a boiling point higher than 32° C. A preferred liquid oxidizer is hydrogen peroxide, which remains in a liquid state throughout the range of 5° C. to 32° C., i.e., solidifies at approximately −0.41° C. Another preferred oxidizer that is found in the liquid state throughout a range of 5° C. to 20° C. is nitrogen tetroxide (or nitrogen dioxide), which is a liquid between about −9.3° C. and 21.1° C.

Unlike conventional emulsion explosives that utilize water to dissolve inorganic salt oxidizers of the discontinuous phase, the emulsion explosive of the present invention is preferably yet optionally contains less than 20 weight percent water, and optionally contains less than 10 weight percent water. In certain embodiments, the emulsion explosive is devoid of water. The low concentrations or omission of water generally raises the sensitivity of the composition, which in turn reduces or eliminates the need for microballoons and other sensitizing additives. Optionally, less than 1 weight percent glass microballoons are used in embodied compositions of the invention.

An emulsifier is used in forming the emulsion. The emulsifier may be selected from known and available emulsifying agents. Examples of such emulsifying agents include sorbitan monooleate, tartaric acid, isopropyl esters of lanolin fatty acids, substituted oxazalines, and numerous other materials. Another emulsifier is polyisobutyl succinic anhydride (PIBSA). Commercially available PIBSA formulations also include mineral oil. Examples of these formulations include CNX125 available from Lubrizol Corporation, Wickliffe, Ohio, which is comprises of 12.5% PBSA emulsifier and 87.5% mineral oil.

The concentrations of liquid fuel of the continuous phase and liquid oxidizer of the discontinuous phase may be varied depending upon the particular fuel(s) and oxidizer(s) selected, and upon the presence of other fuels and ingredients, if any. Generally, the fuel constitutes, for example, about 4 weight percent to about 30 weight percent, more preferably about 5 weight percent to about 15 weight percent of the emulsion explosive. Preferably, the liquid oxidizer (exclusive of an inorganic salts) comprises about 70 weight percent to about 96 weight percent, more preferably about 85 weight percent to about 95 weight percent of the emulsion explosive. The amount of fuel and liquid oxidizer is optionally balanced stoichiometrically, but preferably is slightly fuel rich. The emulsifier constitutes, for example, about 0.25 weight percent to about 5 weight percent of the emulsion phase. Exemplary compositions are as follows: Composition A (13 wt % mineral oil, 2 wt % surfactant, 85 wt % hydrogen peroxide (90% concentrate)); Composition B (10 wt % mineral oil, 2 wt % surfactant, 88% hydrogen peroxide (75% concentrate)).

The emulsion explosives of embodiments of the present invention may be formulated using conventional procedures known in the art. There are, however, certain departures from conventional methods. For example, in preferred embodiments of the present invention in which the emulsion explosive is devoid of inorganic salt oxidizer, there is no need to dissolve the oxidizer salt in water. Instead, the liquid oxidizer may be added directly to a solution of the emulsifier and the immiscible liquid organic fuel. Preferably, the liquid oxidizer and fuel-containing solution or emulsifier solution are approximately equal in temperature when combined. The temperature preferably is in a range at which the oxidizer will remain in the liquid state. Accordingly, the selected temperature will be dependent upon the particular oxidizer selected. The resulting mixture is stirred vigorously to produce an emulsion of the liquid oxidizer in a continuous liquid fuel phase. Stirring should be continued until the formulation is uniform. The formulation process also can be accomplished in a continuous manner as is known in the art. Various modifications to the above-described technique are possible. By way of example, it is advantageous to pre-dissolve the emulsifier in the liquid organic fuel prior to combining the organic fuel with the liquid oxidizer to form an emulsion. This method allows the emulsion to form quickly and without excessive agitation. However, the emulsifier may be added separately as a third component if desired, or may be combined with the liquid oxidizer.

The emulsion explosive of certain embodiments of the present invention significantly reduces, if not eliminates, the problem associated with inorganic salt oxidizers undergoing crystallization and consequent diminishment or loss of detonation properties. The liquid oxidizer of the present invention preferably is not prone to crystallization at temperatures the emulsion explosive will be subjected to in use.

Figure 2:
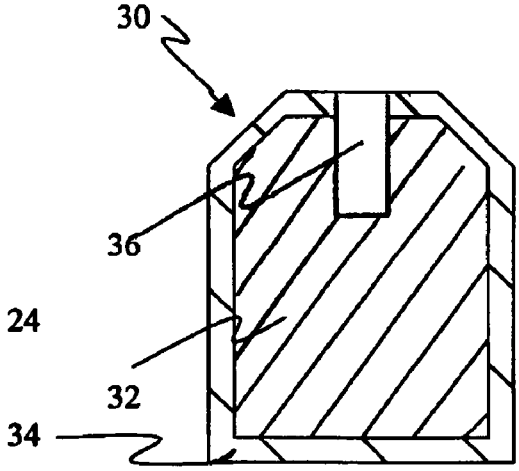
FIG. 2 is a sectional side view of a bomb according to another embodiment of the invention.

The emulsion explosive of the present invention may serve as a component of an article of manufacture, such as a weapon or projectile. For example, FIG. 1 illustrates a projectile, such as a shoulder-launched projectile, generally designated by reference numeral 10. The projectile 10 comprises a warhead casing 12 loaded with an emulsion explosive 14, a fuse 16, a motor case 18 loaded with a propellant charge 20, an end closure 22 for attaching the motor case 18 to the warhead case 12, and an aft nozzle assembly 24 (the left side shown in section) comprising an igniter and a plurality of fins 26. The propellant charge 20 is ignitable to produce hot gases that pass through the nozzle assembly 24 to generate thrust and propel the warhead to its intended target, where the emulsion explosive 14 is detonated. Embodiments of the emulsion explosive composition of the present invention may be cast as explosive 14 into warhead casing 12. Casting techniques are well known in the art. According to another embodiment of the invention, the emulsion explosive may form the explosive charge of a bomb 30, such as shown in FIG. 2. The bomb 30 comprises an explosive emulsion charge 32 loaded within case 34, and a fuse or detonator 36.

The foregoing detailed description of the certain preferred embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims.

What is claimed is:

1. An emulsion explosive, comprising:

a continuous phase comprising a liquid fuel; and a discontinuous phase being dispersed in and immiscible with the continuous phase, the discontinuous phase comprises a plurality of droplets comprised of an oxidizer other than an inorganic oxidizer salt, the oxidizer present in a liquid state, wherein the discontinuous phase of the emulsion explosive includes less than 20 percent water, and wherein the oxidizer is a liquid oxidizer.

2. The emulsion explosive according to claim 1, wherein the liquid fuel comprises a member selected from mineral oil and silicone oil.

3. The emulsion explosive according to claim 1, wherein the oxidizer is in a liquid state throughout a range of 5° C. to 32° C.

4. The emulsion explosive according to claim 3, wherein the oxidizer comprises hydrogen peroxide.

5. The emulsion explosive according to claim 3, wherein the liquid fuel comprises about 4 weight percent to about 30 weight percent of the emulsion explosive, and wherein the liquid oxidizer comprises about 70 weight percent to about 96 weight percent of the emulsion explosive.

6. The emulsion explosive according to claim 3, wherein the liquid fuel comprises about 5 weight percent to about 15 weight percent of the emulsion explosive, and wherein the liquid oxidizer comprises about 85 weight percent to about 95 weight percent of the emulsion explosive.

7. The emulsion explosive according to claim 1, wherein the oxidizer is in a liquid state throughout a range of 5° C. to 20° C.

8. The emulsion explosive according to claim 7, wherein the oxidizer comprises nitrogen tetroxide.

9. The emulsion explosive according to claim 7, wherein the liquid fuel comprises about 4 weight percent to about 30 weight percent of the emulsion explosive, and wherein the liquid oxidizer comprises about 70 weight percent to about 96 weight percent of the emulsion explosive.

10. The emulsion explosive according to claim 7, wherein the liquid fuel comprises about 5 weight percent to about 15 weight percent of the emulsion explosive, and wherein the liquid oxidizer comprises about 85 weight percent to about 95 weight percent of the emulsion explosive.

11. The emulsion explosive according to claim 1, further comprising an emulsifier.

12. The emulsion explosive according to claim 1, wherein the discontinuous phase is free of water.

13. The emulsion explosive according to claim 1, wherein the emulsion explosive is free of microballoons.

14. The emulsion explosive according to claim 1, wherein the discontinuous phase is free of inorganic oxidizing salts.

15. The emulsion explosive according to claim 1, wherein the liquid fuel comprises about 4 weight percent to about 30 weight percent of the emulsion explosive, and wherein the liquid oxidizer comprises about 70 weight percent to about 96 weight percent of the emulsion explosive.

16. The emulsion explosive according to claim 1, wherein the liquid fuel comprises about 5 weight percent to about 15 weight percent of the emulsion explosive, and wherein the liquid oxidizer comprises about 85 weight percent to about 95 weight percent of the emulsion explosive.

* * * * *